US007798345B2

(12) United States Patent
Krome

(10) Patent No.: US 7,798,345 B2
(45) Date of Patent: Sep. 21, 2010

(54) COUPLING FOR RAIL VEHICLES

(75) Inventor: Andreas Krome, Oberreichenbach (DE)

(73) Assignee: Schaeffler KG, Herzogenaurach (DE)

( * ) Notice: Subject to any disclaimer, the term of this patent is extended or adjusted under 35 U.S.C. 154(b) by 26 days.

(21) Appl. No.: 12/376,165

(22) PCT Filed: Jul. 4, 2007

(86) PCT No.: PCT/EP2007/056717

§ 371 (c)(1),
(2), (4) Date: Feb. 3, 2009

(87) PCT Pub. No.: WO2008/015070

PCT Pub. Date: Feb. 7, 2008

(65) Prior Publication Data

US 2010/0006531 A1 Jan. 14, 2010

(30) Foreign Application Priority Data

Aug. 3, 2006 (DE) ..... 10 2006 036 245

(51) Int. Cl.
*B61G 9/00* (2006.01)

(52) U.S. Cl. ..... 213/12; 213/62 R; 213/69; 213/62 A

(58) Field of Classification Search ..... 213/12–14, 213/62 R, 69, 62 A; 105/3, 4.1–4.3
See application file for complete search history.

(56) References Cited

U.S. PATENT DOCUMENTS 3,716,146 A * 2/1973 Altherr ..... 213/75 R
3,841,771 A * 10/1974 Shankwitz et al. ..... 403/163
4,634,299 A * 1/1987 Svensson ..... 384/271
5,035,338 A * 7/1991 Kaufhold et al. ..... 213/50
5,088,832 A * 2/1992 Gambrill et al. ..... 366/314
5,110,221 A * 5/1992 Narkon et al. ..... 384/203
5,172,819 A * 12/1992 Daugherety et al. ..... 213/75 R
5,209,594 A * 5/1993 Svensson et al. ..... 403/11
5,251,986 A * 10/1993 Arena ..... 384/272
5,544,767 A * 8/1996 Daugherty, Jr. ..... 213/50.5
6,024,233 A * 2/2000 Natschke et al. ..... 213/50
6,691,883 B1 * 2/2004 Daugherty, Jr. ..... 213/75 R
2002/0108921 A1 * 8/2002 Ring et al. ..... 213/62 R
2007/0116511 A1 * 5/2007 Schlar et al. ..... 403/122
2010/0006531 A1 * 1/2010 Krome ..... 213/188

FOREIGN PATENT DOCUMENTS

DE 691 08 977 AD 8/1995
DE 695 14 215 A 7/2000
DE 200 04 850 A 9/2000
WO 85/02236 A 5/1985

* cited by examiner

*Primary Examiner*—S. Joseph Morano
*Assistant Examiner*—Jason C Smith
(74) *Attorney, Agent, or Firm*—Lucas & Mercanti, LLP

(57) ABSTRACT

An articulated coupling for rail vehicles is composed of a fork head having two fork pieces and of a coupling link. The coupling link accommodates a spherical joint which is traversed by a pin secured in the fork head. To fasten the pin in the fork piece, there is provided a wedge which is arranged in the axial direction of the pin and has a concavely curved surface adapted to the cylindrical curvature of the surface of the pin.

11 Claims, 4 Drawing Sheets

COUPLING FOR RAIL VEHICLES

FIELD OF THE INVENTION

The invention relates to an articulated coupling which is suitable for the semi-permanent connection of two vehicle units of a rail vehicle. Such an articulated coupling is known, for example, from EP 0 456 222 B1.

BACKGROUND OF THE INVENTION

If two wagon body ends of a rail vehicle are supported on a common bogey, this is referred to as a Jakob's bogey. The individual vehicle units of the rail vehicle are connected in this case by what is referred to as a short coupling, which is generally released only for maintenance or repair purposes. Short couplings can be used for the semi-permanent connection of two or more vehicles and can be found, for example, in commuter trains. Short couplings are also used in goods traffic. At any rate, it is necessary for the articulated coupling to be movable in all three spatial directions.

OBJECT OF THE INVENTION

The invention is based on the object of specifying an articulated coupling which is suitable for rail vehicles and which is defined by a particularly easy mounting process accompanied by a design which is compatible with loading.

SUMMARY OF THE INVENTION

This object is achieved according to the invention by means of an articulated coupling that a fork head, which is also referred to as a female element and has two fork elements, as well as a coupling lug, which is also referred to as a male element. A bolt is held in the fork head which is connected to a first vehicle unit, said bolt penetrating a spherical joint which is held in the coupling lug which is connected to a second vehicle unit. In order to fix the bolt, preferably arranged in a horizontal installation position, in the fork element, a wedge is provided which is arranged in the axial direction of the bolt and has a concavely curved surface matching the cylindrical curvature of the surface of the bolt. The direction of extent, i.e. the advancing direction, of the wedge, therefore corresponds to the axial direction of the bolt. The articulated coupling which is embodied as a short coupling is defined by simplicity of design and a high degree of rigidity accompanied by a low weight.

The wedge angle is preferably dimensioned such that the wedge is secured in a self-locking fashion between the bolt and a stop face of the fork element. Furthermore the wedge which secures the bolt without play in the fork head can be attached to the fork element and/or to the bolt by means of screw connections. While the wedge has a concavely curved face and a preferably flattened face lying opposite said face, the bolt is either completely cylindrical in shape or predominantly cylindrical with a flattened portion parallel to the axis. At any rate, the wedge bears against a cylindrically curved section of the bolt. The surface of the wedge which faces away from the bolt and bears against the fork head can be convexly curved, meaning that both surfaces of the wedge which are responsible for the wedge effect can therefore be curved. As a result it is possible for forces which act particularly uniformly in a radial direction on the bolt from the outside to be generated by the wedge.

The flattened portion of the bolt bears, if appropriate, against a stop face of the fork element and is arranged in a normal direction with respect to the longitudinal direction of the fork element, i.e. in a normal direction with respect to the pulling direction which corresponds to the longitudinal direction of the vehicle. Irrespective of whether the bolt is flattened, the bearing face which is formed on the fork element preferably extends on both sides of a plane which runs through the axis of the bolt and whose normal encloses a right angle with the longitudinal direction of the vehicle. Given a horizontal installation position of the bolt, this plane is a horizontal plane. On one side of this plane, the bearing face of the fork element preferably extends over an angle of less than 90° with respect to the circumference of the bolt, while on the other side of the plane the bearing face covers an angle of more than 90°. Overall, the bolt preferably bears with somewhat less than half its circumference against the fork element. This permits particularly simple mounting of the bolt. The fork elements have corresponding openings which permit the bolt to be inserted essentially in the radial direction. In the mounted state of the articulated coupling, the wedge bears, in a preferred refinement, against at least ⅙ of the circumference of the bolt. In this refinement, at least ⅔ of the circumference of the bolt is in contact either with the fork element or the wedge. For the purpose of simple dismounting of the wedge, a pulling-off device, in particular a pulling-off thread, can be integrated into said wedge.

The spherical joint, which has angle mobility through all three spatial axes without linear degrees of freedom can be provided for lubrication with grease or oil and/or be embodied with a sliding fabric. At any rate, the outer ring of the joint can be fabricated in one part or multiple parts, in particular in the form of a split bearing ring. The internal ring of the spherical joint which is penetrated by the bolt is preferably a part which is separate from the bolt. The internal ring is alternatively embodied in one piece with the bolt.

An effective protection of the spherical joint against soiling or other influences which promote wear, such as moisture, ice, snow, dust or possibly contaminated lubricants, can be achieved by means of a seal which is preferably embodied as a folding bellows seal. Likewise, a slipping sealing ring, described in application DE 10 2006 023 566.5 (application date: May 19, 2006), is suitable as a sealing means.

The seal is mounted, without restricting the mobility of the spherical joint, in such a way that regions of the seal which are secured to the joint can, when necessary, for example when the rotational joint is changed, slip through, without the risk of damage to the seal. Suitable for reliably fixing the seal are clamping elements such as round wire rings or endless spiral springs, wherein there is no need for pretensioning of the actual folding bellows material. The clamping elements engage, for example, around support rings which surround the bolt on both sides of the spherical joint and which take up axial forces which act on the spherical joint. Each support ring is arranged here between the internal ring of the spherical joint and one of the fork elements. According to an alternative refinement, the two support rings are integral components of the internal ring.

In all the embodiments, the articulated coupling has favorable pressure distribution and, in conjunction therewith, a high degree of force absorption capacity, while the coupling can be disconnected or connected, and the individual bearing elements replaced, with little effort.

Two exemplary embodiments of the invention will be explained in more detail below with reference to a drawing, in which:

DETAILED DESCRIPTION OF THE DRAWING

Figure 1:
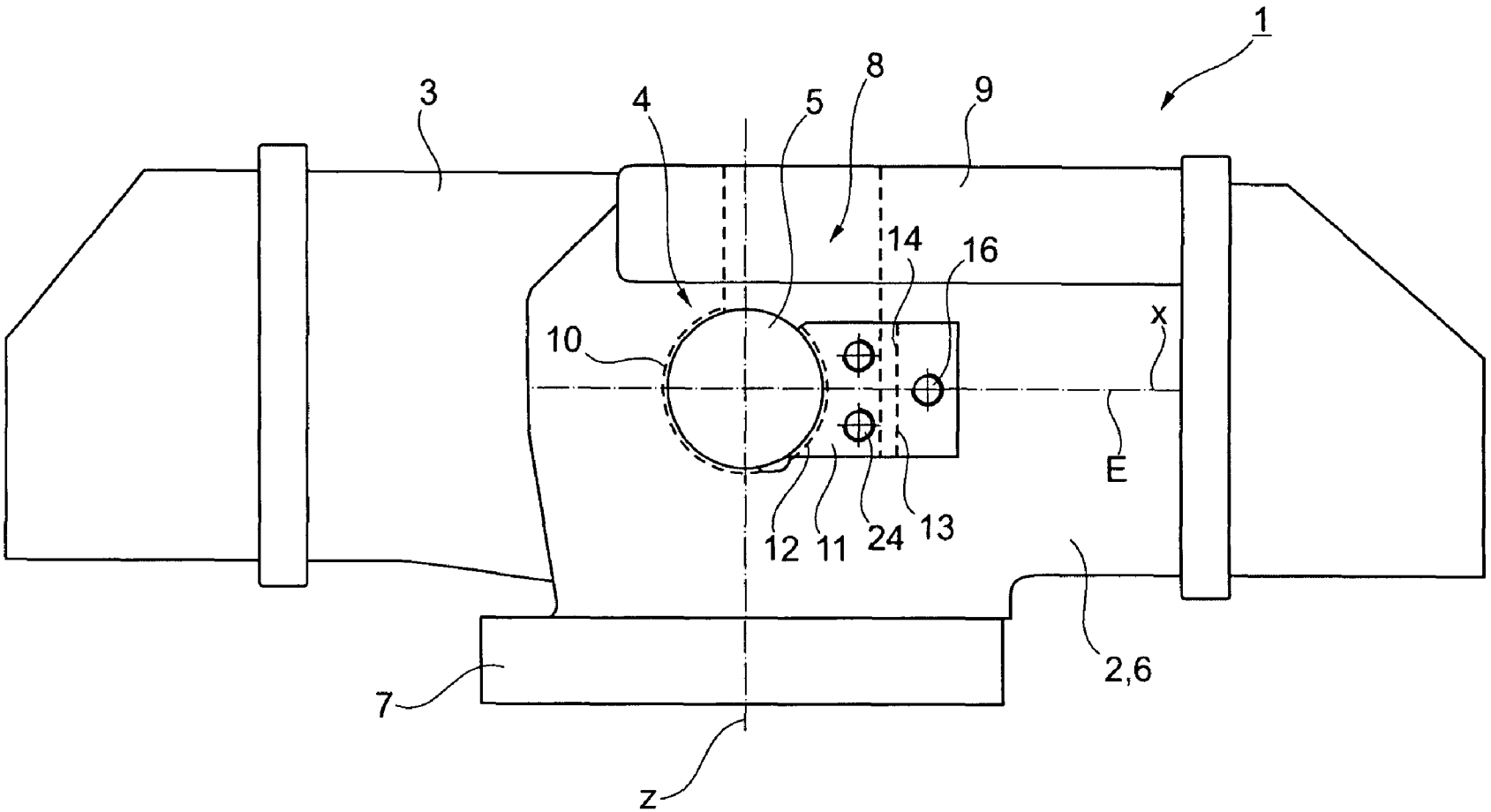
FIG. 1 shows an articulated coupling for rail vehicles in a side view.
Figure 2:
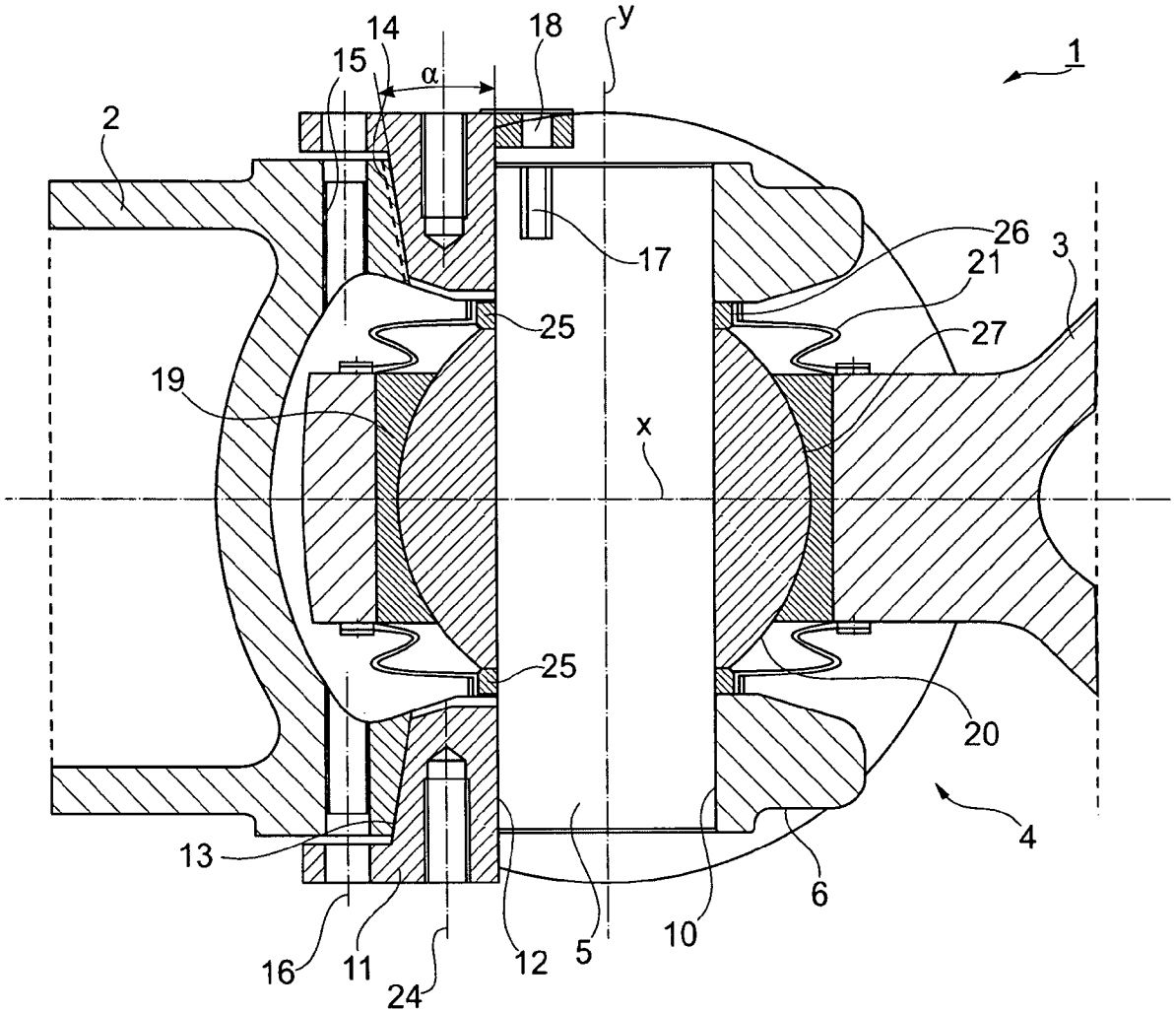
FIG. 2 shows a sectional illustration of the articulated coupling according to FIG. 1.

FIGS. 1 and 2 show in simplified form an articulated coupling 1 for rail vehicles, with respect to whose basic function reference is made, for example, to DE 41 21 080 A1. The articulated coupling 1 is used for the semi-permanent coupling of a first vehicle, to which a fork head 2 is attached, to a second vehicle to which a coupling lug 3 is attached. The connection, which is articulated in all spatial directions, between the fork head 2 and the coupling lug 3, is implemented by means of a spherical joint 4 which is penetrated by a bolt 5 which is held in two fork pieces 6 of the fork head 2. The bolt 5 is in the horizontal installation position in the articulated coupling 1 and is arranged transversely with respect to the longitudinal direction of the vehicle which is referred to as the x direction or longitudinal axis. The axis of symmetry of the bolt 5 corresponds to the y axis, also referred to as the transverse axis, of a right-angled coordinate system.

The fork head 2 has, on its underside, a horizontally arranged plate 7 which is supported on a bogey (not illustrated) of the rail vehicle. A rotational axis of the bogey is identical to the vertical z axis, also referred to as the vertical axis, which intersects the axis of symmetry y of the bolt 5 perpendicularly. The bolt 5 can be inserted into the fork head 2 in an essentially radial direction from above, through two openings 8 in the fork elements 6. In order to reinforce the fork head 2 in the region of the openings 8, lateral reinforcements 9 are formed on the upper edge of the fork elements 6, as integral components of the fork elements 6.

In the exemplary embodiment according to FIGS. 1 and 2, the bolt 5 is of completely cylindrical design and bears against a concavely curved bearing face 10 of the fork element 6. This concave bearing face 10 has a radius of curvature which corresponds at least approximately to the radius of curvature of the bolt 5 and extends over an angle of just under 180° so that it is not necessary to insert the bolt 5 in the axial direction, i.e. in the y direction. The concave bearing face 10 extends both above and below a horizontally mounted plane E passing through the x and y axes. In this context, the bearing face 10 covers an angle of just less than 90° in the region above the plane E, and an angle of somewhat more than 90° in the region below the plane E. This means that as long as no further forces act on the bolt 5, said bolt 5 would remain in the correct position in the fork head 2 simply due to the force of gravity. In order to press the bolt 5 against the concave bearing face 10, a wedge 11 is provided whose advancing direction is identical to the y direction. The wedge 11 has a concave bearing face 12 matching the contour of the bolt 5, and a planar bearing face 13 which, in the section according to FIG. 2, is positioned obliquely at a wedge angle $\alpha$ with respect thereto. The last-mentioned bearing face 13 of the wedge 11 is in contact with a planar bearing face 14 on the fork element 6 which is oriented vertically and is positioned obliquely at the wedge angle $\alpha$ in relation to the y-z plane. As a result of the frictional engagement between the bolt 5, the wedge 11 and the fork element 11, the bolt 5 is secured both against axial displacement and against rotation, without any weakening of its cross section.

The fork element 6 has, as is apparent from FIG. 2, a threaded bore 15 which is aligned with a through-bore 16 in the wedge 11 and permits the wedge 11 to be screwed to the fork head 2. As an option, threaded bolts 17, which are aligned with through-bores 18 in the wedge 11 and permit a screwed connection between the wedge 11 and the bolt 5, can also be provided in the bolt 5, as illustrated in the upper half of FIG. 2. In this way it is possible to avoid or at least minimize tilting moments on the wedge 11. The wedge 11 is in any case inserted only so far into the fork element 6 that the mobility of the spherical joint 4 is not restricted. Parallel to the y axis, pulling-off threads 24, which, as a pulling-off device, permit easy dismounting of the articulated coupling 1, are located between the through-bores 16, 18 in the wedge 11.

The spherical joint 4, which has an outer ring 19 which is rigidly connected to the coupling lug 3, and an internal ring 20, is protected against soiling by a folding bellows 21, as a sealing device, on each of the two sides of the coupling lug 3. Each folding bellows 21 is held, at one end, to a side face, extending parallel to the x-z plane, of the coupling lug 3 and, at the other end, to a supporting ring 25 which surrounds the bolt 5 and is arranged between the internal ring 20 and one of the fork elements 6. In contrast to the illustrated exemplary embodiment, the supporting ring 25 can also be a component of the internal ring 20. In order to secure the folding bellows 21 on the supporting ring 25, which supports the internal ring 20 in the axial direction of the bolt 5 with respect to the fork element 6, a clamping element 26 made of steel, namely a spring clamped around the supporting ring 25, is provided. The sealing device 21 ensures, in particular, that a sliding fabric 27, which is used to permit sliding bearing between the internal ring 20 and the outer ring 21 of the articulated coupling 1 which is embodied as a radial articulated bearing, continues to be protected against external influences.

Figure 3:
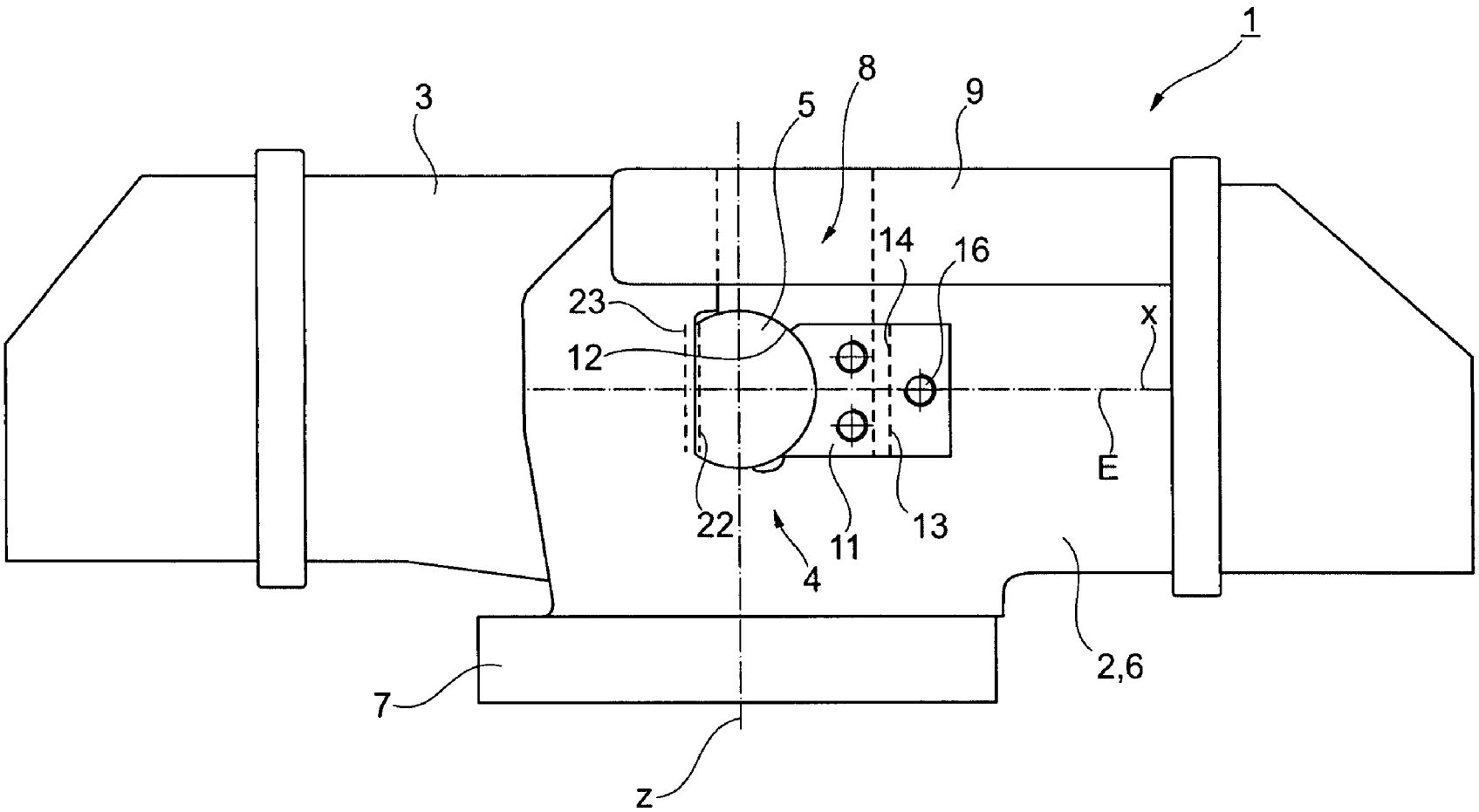
FIG. 3 shows a second exemplary embodiment of an articulated coupling for rail vehicles in a view analogous to FIG. 1.
Figure 4:
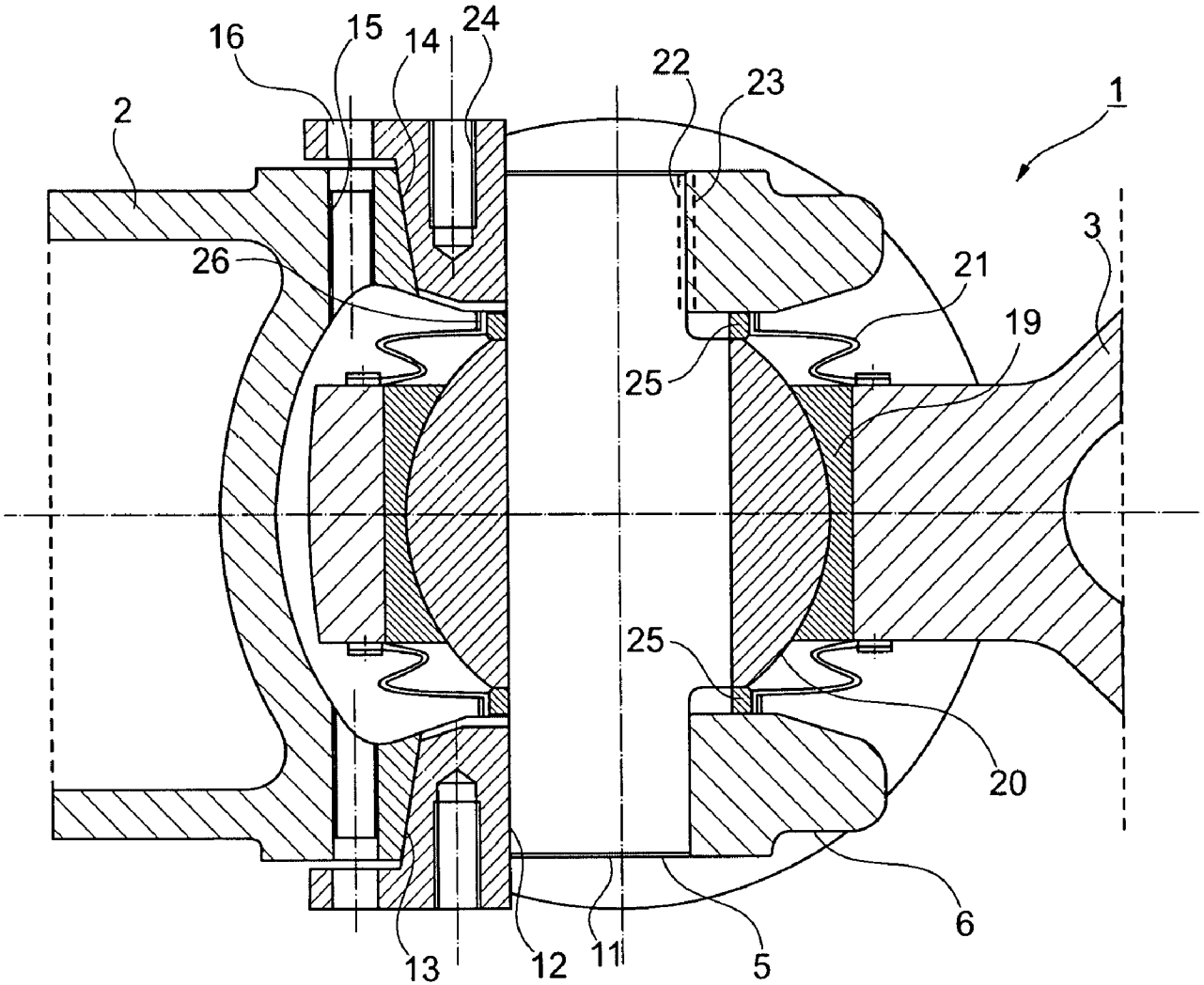
FIG. 4 shows a sectional illustration, analogous to FIG. 2, of the articulated coupling according to FIG. 3.

The exemplary embodiment according to FIGS. 3 and 4 differs from the exemplary embodiment according to FIGS. 1 and 2 essentially in that the bolt 5 has, on the face opposite the wedge 11, a flattened portion 22 which bears against a bearing face 23, which is also planar, of the fork element 6. As a result, the bolt 5 is secured against rotation in a positively locking fashion.

In this case, the fork element 6 has two planar bearing faces 14, 23, which lie opposite one another and which are positioned obliquely in relation to one another at the wedge angle $\alpha$. In contrast, the bearing faces 10, 12, at which the bolt 5 and the wedge 11 are in contact, are curved in a cylindrical fashion, as in the exemplary embodiment according to FIGS. 1 and 2. The installation and removal of the bolt 5 is carried out in the way described with reference to FIGS. 1 and 2.

LIST OF REFERENCE SYMBOLS

1 articulated coupling
2 fork head
3 coupling lug
4 spherical joint
5 bolt
6 fork element
7 plate
8 opening

9 reinforcement
10 concave bearing face of the fork element
11 wedge
12 concave bearing face of the wedge
13 planar bearing face of the wedge
14 planar bearing face of the fork element
15 threaded bore in the fork element
16 through-bore
17 threaded bore
18 through-bore
19 outer ring
20 internal ring
21 folding bellows
22 flattened portion of the bolt
23 planar bearing face of the fork element
24 pulling-off thread
25 supporting ring
26 clamping element
27 sliding fabric
$\alpha$ wedge angle
E plane
x, y, z longitudinal axis, transverse axis, vertical axis

The invention claimed is:

1. An articulated coupling for rail vehicles, comprising:

a fork head which is provided for connecting to a first vehicle unit;

two fork elements; and a coupling lug which is provided for connecting to a second vehicle unit, wherein a spherical joint is held in the coupling lug and is penetrated by a bolt which is secured in the fork head, wherein a wedge which fixes the bolt in the fork element and is arranged in the axial direction of the bolt and has a concavely curved surface matching the cylindrical curvature of the surface of the bolt, and wherein the wedge is clamped in a self-locking fashion between the bolt and a stop face, positioned obliquely with respect to the axis of the bolt, on the fork elements.

2. The articulated coupling as claimed in claim 1, wherein the wedge is screwed to the fork elements.

3. The articulated coupling as claimed in claim 1, wherein that wedge is screwed to the bolt.

4. The articulated coupling as claimed in claim 1 , wherein the bolt is cylindrical.

5. The articulated coupling as claimed in claim 1, wherein the bolt has a flattened stop face which runs axially parallel.

6. The articulated coupling as claimed in claim 5, wherein the fork element has a stop face which interacts with the stop face of the bolt and is arranged in a normal direction with respect to a longitudinal direction (x) of the fork element.

7. The articulated coupling as claimed in claim 1, wherein the bolt bears with less than half its circumference against the fork element.

8. The articulated coupling as claimed in claim 1, wherein the wedge bears against at least one sixth of the circumference of the bolt.

9. The articulated coupling as claimed in claim 1, wherein the fork element and the wedge together bear against more than two-thirds of the circumference of the bolt.

10. The articulated coupling as claimed in claim 1, wherein the wedge has a pulling-off device, in particular a pulling-off thread, which can be used to dismount it.

11. The articulated coupling as claimed in claim 1, wherein a folding bellows is provided to protect the spherical joint 4.

* * * * *